US005888946A

United States Patent [19]

Zakarian et al.

[11] Patent Number: 5,888,946

[45] Date of Patent: Mar. 30, 1999

[54] TRACTOR HYDRAULIC FLUID

[75] Inventors: John A. Zakarian, Kensington; Gene E. Robinson, Concord, both of Calif.

[73] Assignee: Chevron U.S.A. Inc., San Francisco, Calif.

[21] Appl. No.: 1,169

[22] Filed: Dec. 30, 1997

[51] Int. Cl.[6] ..... C10M 145/14

[52] U.S. Cl. ..... 508/469; 252/79

[58] Field of Search ..... 508/469

[56] References Cited

U.S. PATENT DOCUMENTS

| | | | |
|---|---|---|---|
| 3,354,087 | 11/1967 | Bailey, Jr. et al. | 508/469 |
| 3,679,644 | 7/1972 | Van Der Meij et al. | 508/469 |
| 3,833,501 | 9/1974 | Elliott et al. | 508/469 |
| 4,031,020 | 6/1977 | Sugiura et al. | 508/469 |
| 4,776,967 | 10/1988 | Ichihashi et al. | 508/469 |
| 4,857,220 | 8/1989 | Hashimoto | 508/469 |
| 5,149,452 | 9/1992 | MacAlpine et al. | 508/469 |
| 5,188,770 | 2/1993 | Pennewiss | 508/469 |
| 5,520,832 | 5/1996 | Alexander | 508/469 |

*Primary Examiner*—Ellen M. McAvoy
*Attorney, Agent, or Firm*—Timothy J. Hadlock

[57] ABSTRACT

The invention includes a tractor hydraulic fluid composition containing a major amount of a base oil mixture. The base oil mixture includes a first mineral oil having a kinematic viscosity at 100° C. of at least about 4.0 centistokes and a second mineral oil having a kinematic viscosity at 100° C. of at least about 7.0 centistokes. The tractor hydraulic fluid composition also contains a first polymethacrylate viscosity index improver and a second polymethacrylate viscosity index improver having a lower shear stability index than the first polymethacrylate viscosity index improver. The tractor hydraulic fluid composition has an unsheared kinematic viscosity at 100° C. of at least about 9.1 centistokes, a sheared kinematic viscosity at 100° C. of at least about 7.1 centistokes, and an unsheared kinematic viscosity at −40° C. of not more than about 20,000 centipoise.

14 Claims, No Drawings

TRACTOR HYDRAULIC FLUID

I. FIELD OF THE INVENTION

The present invention relates to a lubrication fluid. More specifically, the invention relates to a tractor hydraulic fluid suitable for use in both Summer and Winter.

II. BACKGROUND OF THE INVENTION

Tractor hydraulic fluids are multi-application lubricants that are used in transmissions, differentials, final-drive planetary gears, wet-brakes and hydraulic systems of off-highway mobile equipment. Different types of fluids are used in such equipment depending on the design and severity of application. Generally, tractor fluids are designed to meet specific manufacturer requirements.

Some new types of tractors and other off-highway equipment have strict viscometric requirements which standard tractor hydraulic fluids have difficulty in meeting. Moreover, these stricter viscometric requirements may result in seasonal oil changes and even reformulation depending on such seasonal and application requirements.

It would be desirable to have a Summer/Winter, wide temperature range multi-application tractor hydraulic fluid so as to reduce the number of lubricants required on-site to meet different needs and to minimize or avoid oil changes due to seasonal changes.

One example of a tractor hydraulic fluid with a wide operating temperature range is disclosed in U.S. Pat. No. 5,520,832. However, the fluid of that invention does not fully meet the all-season requirements of one of the largest tractor manufacturers, John Deere. In particular, the fluid of that invention does not have sufficient viscosity at high temperature. The fluid of the present invention does fully meet the requirements of John Deere specifications JDM J20C and JDM J20D.

III. SUMMARY OF THE INVENTION

The present invention provides for a superior tractor hydraulic fluid composition for use in both Summer and Winter. This fluid fully meets the all-weather requirements of John Deere, as specified in JDM J20C and JDM J20D.

The invention includes a lubricating composition containing a major amount of a base oil mixture. The base oil mixture includes a first high viscosity index mineral oil having a kinematic viscosity at 100° C. of at least about 3.0 centistokes and a second high viscosity index mineral oil having a kinematic viscosity at 100° C. of at least about 5.0 centistokes. The tractor hydraulic fluid composition also contains a first polymethacrylate viscosity index improver and a second polymethacrylate viscosity index improver having a greater thickening efficiency and a lower shear stability than the first polymethacrylate viscosity index improver. The tractor hydraulic fluid composition has an unsheared kinematic viscosity at 100° C. of at least about 9.1 centistokes, a sheared kinematic viscosity at 100° C. of at least about 7.1 centistokes, and a Brookfield viscosity at −40° C. of not more than about 20,000 centipoise.

IV. DETAILED DESCRIPTION OF PREFERRED EMBODIMENTS

A. Base Oils

The lubricating oil base oil mixture contains a blend of a first high viscosity index mineral oil and a second high viscosity index mineral oil. Both mineral oils are paraffinic. The term "high viscosity index" mineral oil as used in this specification and appended claims means (1) a viscosity index of at least 90 for a mineral oil having a viscosity of 3.0 centistokes at 100° C.; (2) a viscosity index of at least 105 for a mineral oil having a viscosity of 4 centistokes at 100° C.; (3) a viscosity index of at least 115 for a mineral oil having a viscosity of 5.0 centistokes at 100° C.; and (4) a viscosity index of at least 120 for a mineral oil having a viscosity of 7.0 centistokes at 100° C. "High" viscosity indices for other viscosities between 3.0 and 7.0 can be determined by conventional interpolation.

The viscosity indices of the base oils of the present invention are much higher than those commonly used in the industry. The "high viscosity index" base oils of the present invention are also referred to as "Unconventional Base Oils". The preferred method of manufacture for the Unconventional Base Oils is a combination of hydrocracking followed by catalytic dewaxing. Two such processes for preferred base oil manufacture are licensed under the names of ISOCRACKING and ISODEWAXING.

One of the mineral oils has a higher viscosity than the other mineral oil. The second high viscosity index mineral oil is the higher viscosity component of the base oil mixture, preferably with a viscosity of at least 5.0 cSt at 100° C. The first high viscosity index mineral oil is the lower viscosity component of the base oil mixture. It preferably has a viscosity of at least 3.0 cSt at 100° C. More preferably, the second high viscosity index mineral oil has a viscosity of at least 6.5 cSt at 100° C. or 7.0 cSt at 100 ° C. and the first high viscosity index mineral oil has a viscosity of at least 3.7 cSt at 100° C. or 4.0 cSt at 100 ° C. The weight ratio of the first mineral oil to the second mineral oil is from about 95:5 to about 20:80, preferably from about 80:20 to about 35:65.

The base oil mixture provides for good low temperature performance while maintaining a minimum oil film thickness to protect moving parts such as bearings and gears. The first mineral oil component enables the finished oil to achieve a low pour point and a maximum Brookfield viscosity of 20,000 centipoise at −40° C. The second mineral oil component provides the necessary oil film thickness to protect moving parts at high temperatures. Neither base oil component alone would impart all season properties to the finished oil.

The viscosity index improver is likewise a blend of two components. The first component is a polymethacrylate having a lower molecular weight than the second viscosity index improver and a shear stability index of less than about 30. The terms "sheared," "shear stability index (SSI)," and "shear stability" as used in this specification and appended claims each mean as measured by the Sonic Shear Method as set forth in ASTM Test D-5621. The shear stability index is calculated as follows:

$$SSI=(Vi-Vf)*100/(Vi-Vb),$$

where Vi is the initial viscosity in centistokes at 100° C. of the fresh, unsheared tractor fluid; Vf is the final viscosity in centistokes at 100° C. of the tractor fluid after the 40-minute D5621 shear procedure; and Vb is the viscosity in centistokes at 100° C. of the tractor fluid base mixture without the polymethacrylate viscosity index improvers added.

This lower molecular weight viscosity index improver is present at from 1 to 10 wt. %, preferably 4 to 8 wt. % based on the weight of the lubricating composition. The second viscosity index improver has a higher molecular weight. It is also a polymethacrylate having a shear stability index of greater than about 50. The amount of this component is from 1 to 10 wt. %, preferably 2 to 5 wt. %, based on oil composition. Thus, the first component has a lower thickening efficiency and higher shear stability than the second polymethacrylate viscosity index improver.

The first and second polymethacrylate viscosity index improvers are present in sufficient amounts so that said tractor hydraulic fluid composition has an unsheared kinematic viscosity at 100° C. of at least about 9.1 centistokes; a sheared kinematic viscosity at 100° C. of at least about 7.1 centistokes; and a Brookfield viscosity at −40° C. of no greater than about 20,000 centipoise.

An example of the first polymethacrylate is commercially available from Rohmax under the trade name VISCOPLEX 0-220 Registered™. An example of the second polymethacrylate is commercially available from Rohmax under the trade name ACRYLOID 954 Registered™.

This blend of two viscosity index improvers provides the formulated oil with the viscometric properties needed for new tractors and other equipment. The lower molecular weight polymethacrylate imparts the minimum after-shear kinematic viscosity of 7.1 cSt at 100° C. while the higher molecular weight polymethacrylate aids in providing a higher kinematic viscosity at 100° C. The mixture provides an unsheared kinematic viscosity at 100° C. of at least about 9.1 cSt. The combination of viscosity index improvers when blended with the base oil mixture provides a formulated oil having excellent wide temperature range performance.

The lubricating composition will typically include a performance additive package. The term "performance additive package" as used in this specification and appended claims means any combination of other conventional additives for lubricating compositions. Such additives include corrosion and rust inhibitors, anti-oxidants, dispersants, detergents, anti-foam agents, anti-wear agents, friction modifiers and flow improvers. Such additives are described in "Lubricants and Related Products" by Dieter Klamann, Verlag Chemie, Deerfield Beach, Fla., 1984.

V. ILLUSTRATIVE EMBODIMENTS

The invention will be further clarified by the following Illustrative Embodiments 1–4, which are intended to be purely exemplary of the invention and which include preferred embodiments of the invention and Comparative Examples A–G.

The target specifications for the Summer/Winter tractor hydraulic fluids are given in Table 1.

TABLE 1

| Property | Target Value | Method of Measurement |
|---|---|---|
| Unsheared Kinematic Viscosity at 100° C. | ≧9.1 cSt. | ASTM D-445 |
| Sheared Kinematic Viscosity at 100° C. | ≧7.1 cSt. | Shear: ASTM D-5621. Vis: ASTM D-445 |
| Brookfield Viscosity at −40° C. | ≦20,000 centipoise | ASTM D-2983 |

Various tractor hydraulic fluid blends were prepared from the following components:

I. A high viscosity index mineral base oil having a viscosity of about 4.2 cSt at 100° C. and a viscosity index of 129 (CHEVRON UCBO 4R brand lubricating oil).

II. A high viscosity index mineral base oil having a viscosity of about 6.8 cSt at 100° C. and a viscosity index of 144 (CHEVRON UCBO 7R brand lubricating oil).

III. A polymethacrylate viscosity index improver having a shear stability index of about 22 and manufactured by Rohmax (VISCOPLEX 0-220 brand viscosity index improver).

IV. A polymethacrylate viscosity index improver having a shear stability index of about 75 and manufactured by Rohmax (ACRYLOID 954 brand viscosity index improver).

V. Commercially available additive packages containing such components as antiwear agent, detergent, antirust agent, copper corrosion inhibitor, antioxidant, friction modifier, pour point depressant and antifoam.

TABLE 2

| Illustrative Embodiment Component | 1 Wt. % | 2 Wt. % | 3 Wt. % | 4 Wt. % |
|---|---|---|---|---|
| I | 62.95 | 62.95 | 42.23 | 50.00 |
| II | 20.00 | 20.00 | 42.22 | 33.75 |
| III | 5.00 | 6.00 | 5.00 | 5.70 |
| IV | 4.50 | 3.50 | 3.00 | 3.00 |
| V | 7.55 | 7.55 | 7.55 | 7.55 |
| Total Wt. % | 100.0 | 100.0 | 100.0 | 100.0 |
| Experiment | 1 | 2 | 3 | 4 |
| Resulting Properties | | | | |
| Unsheared Viscosity at 100° C. (cSt). | 9.861 | 9.414 | 9.509 | 9.491 |
| Sheared Kinematic Viscosity at 100° C. (cSt) | 7.209 | 7.263 | 7.609 | 7.599 |
| Brookfield Viscosity at −40° C. (centipoise) | 18,220 | 14,080 | 18,520 | 14,240 |
| Unsheared Viscosity Index | 218 | 213 | 203 | 205 |

TABLE 3

| Comparative Examples Component* | A Wt. % | B Wt. % | C Wt. % | D Wt % | E Wt. % | F Wt. % | G Wt. % |
|---|---|---|---|---|---|---|---|
| I | 62.95 | 62.95 | 0.0 | 83.94 | 43.15 | 65.08 | 0.0 |
| II | 21.00 | 21.00 | 89.05 | 0.0 | 43.15 | 16.27 | 0.0 |
| III | 5.50 | 6.00 | 0.0 | 0.0 | 0.0 | 11.0 | 0.0 |
| IV | 3.00 | 2.50 | 3.2 | 8.3 | 6.1 | 0.0 | 3.5 |
| V | 7.55 | 7.55 | 7.75 | 7.76 | 7.6 | 7.65 | 7.55 |
| VI | | | | | | | 10.0 |
| VII | | | | | | | 78.95 |
| Total Wt. % | 100.0 | 100.0 | 100.0 | 100.0 | 100.0 | 100.0 | 100.0 |
| Resulting Properties | | | | | | | |
| Unsheared Vis. @ 100° C. (cSt) | 8.794 | 8.619 | 9.24 | 9.29 | 9.36 | 8.561 | 9.51 |
| Sheared Vis. @ 100° C. (cSt) | 6.997 | 7.049 | 7.76 | 6.11 | 6.85 | 7.74 | 7.26 |
| Brookfield Vis. @ −40° C. (cP) | 12,700 | 12,080 | 39,500 | 117,400 | 236,000 | 12,380 | >70,000 |

Illustrative Embodiments 1 and 2 demonstrate that for a given amount of components I and II, one must adjust the amount of components III and IV until the target specifications given in Table 1 are met in the desired ranges. Thus, at 62.95 wt. % component I and 20 wt. % component II, increasing the amount of good shear stability, low molecular weight polymethacrylate (component III) and decreasing the amount of poor shear stability, high molecular weight polymethacrylate (component IV) decreases the kinematic viscosity of the unsheared lubricating composition and increases the kinematic viscosity of the sheared lubricating composition.

Illustrative Embodiments 3 and 4 demonstrate that the target specifications can also be met by reducing the amount of the high thickening efficiency viscosity index improver polymethacrylate (component IV) and increasing the amount of the higher viscosity mineral oil (component II).

Comparative Examples A and B illustrate that too little of the high thickening efficiency viscosity index improver (component IV) results in too low a sheared and unsheared kinematic viscosity at 100° C.

Comparative Example C illustrates that too little of the lower viscosity mineral oil (component I) results in too high a Brookfield viscosity at −40° C. Comparative Example D illustrates that too little of the higher viscosity mineral oil (component II) results in not only too high a Brookfield viscosity at −40° C. but also in too low an unsheared kinematic viscosity at 100° C.

Comparative Example E illustrates that use of only one viscosity index improver, the high thickening efficiency component IV, results in too low a sheared kinematic viscosity at 100° C. It also results in too high a Brookfield viscosity at −40° C.

Comparative Example F illustrates that use of only the good shear stability viscosity index improver (component III) does provide an acceptable viscosity at 100° C. after shear. However, component III does not have good thickening efficiency and the blended product has too low an unsheared kinematic viscosity at 100° C.

In Comparative Example G, two non-high viscosity index mineral oils ("conventional" base oils) were used (components VI and VII). Component VI was a mineral oil having a viscosity of 4.1 at 100° C. and a viscosity index of 102 (CHEVRON 100R brand lubricating oil). Component VII was a mineral oil having a viscosity of 6.9 at 100° C. and a viscosity index of 102 (CHEVRON 240R brand lubricating oil). Comparative Example G illustrates that too little of the high viscosity index mineral oils (components I and II) results in too high a Brookfield viscosity at −40° C.

What is claimed is:

1. A lubricating composition comprising:

(a) a major amount of a base oil mixture comprising:

(1) a first high viscosity index mineral oil having a kinematic viscosity at 100° C. of at least about 4.0 centistokes; and (2) a second high viscosity index mineral oil having a kinematic viscosity at 100° C. of at least about 7.0 centistokes;

(b) a first polymethacrylate polymer;

(c) a second polymethacrylate polymer;

(d) a performance additive package; and (e) wherein said lubricating composition has:

(1) an unsheared kinematic viscosity at 100° C. of at least about 9.1 centistokes;

(2) a sheared kinematic viscosity at 100° C. of at least about 7.1 centistokes; and (3) a Brookfield viscosity at −40° C. of no greater than about 20,000 centipoise.

2. The lubricating composition of claim 1, wherein said lubricating composition is a tractor hydraulic fluid.

3. The lubricating composition of claim 1, wherein said first polymethacrylate polymer and said second polymethacrylate polymer each is adapted for viscosity index improvement of a natural lubricating oil.

4. The lubricating composition of claim 1, wherein said second polymethacrylate polymer has a higher thickening efficiency and a lower shear stability than said first polymethacrylate polymer.

5. The lubricating composition of claim 1, wherein the weight ratio of said first high viscosity index mineral oil to said second high viscosity index mineral oil is from about 95:5 to about 20:80.

6. The lubricating composition of claim 1, wherein the weight ratio of said first high viscosity index mineral oil to said second high viscosity index mineral oil is from about 95:5 to about 20:80.

7. The lubricating composition of claim 1, wherein the weight ratio of said first high viscosity index mineral oil to said second high viscosity index mineral oil is from about 80:20 to about 35:65.

8. The lubricating composition of claim 1, wherein said lubricating composition contains from about 1 weight percent to about 10 weight percent, based on the weight of said lubricating composition, of said first polymethacrylate polymer and a diluent.

9. The lubricating composition of claim 1, wherein said lubricating composition contains from about 1 weight percent to about 10 weight percent, based on the weight of said lubricating composition, of said second polymethacrylate polymer and a diluent.

10. A tractor hydraulic fluid composition comprising:

(a) a major amount of a lubricating oil mixture comprising:

(1) a first natural lubricating oil having a kinematic viscosity at 100° C. of at least about 4.0 centistokes;

(2) a second natural lubricating oil having a kinematic viscosity at 100° C. of at least about 7.0 centistokes; and (3) wherein the weight ratio of said first natural lubricating oil to said second natural lubricating oil is from about 95:5 to about 20:80;

(b) a performance additive package; and (c) a viscosity index improver package comprising:

(1) a first polymethacrylate viscosity index improver;

(2) a second polymethacrylate viscosity index improver having a higher thickening efficiency and lower shear stability than said first polymethacrylate viscosity index improver; and (3) wherein said first and second polymethacrylate viscosity index improvers are present in a sufficient amounts so that said tractor hydraulic fluid composition has:

(a) an unsheared kinematic viscosity at 100° C. of at least about 9.1 centistokes;

(b) a sheared kinematic viscosity at 100° C. of at least about 7.1 centistokes; and (c) a Brookfield viscosity at −40° C. of no greater than about 20,000 centipoise.

11. The tractor hydraulic fluid composition of claim 10, wherein the weight ratio of said first natural lubricating oil to said second natural lubricating oil is from about 80:20 to about 35:65.

12. The tractor hydraulic fluid composition of claim 10, wherein said tractor hydraulic fluid composition contains from about 4 weight percent to about 8 weight percent, based on the weight of said tractor hydraulic fluid composition, of said first polymethacrylate viscosity index improver.

13. The tractor hydraulic fluid composition of claim 12, wherein said tractor hydraulic fluid composition contains from about 2 weight percent to about 5 weight percent, based on the weight of said tractor hydraulic fluid composition, of said second polymethacrylate viscosity index improver.

14. A tractor hydraulic fluid composition comprising:

(a) a major amount of a base oil mixture comprising:

(1) a first mineral oil having a kinematic viscosity at 100° C. of at least about 4.0 centistokes;

(2) a second mineral oil having a kinematic viscosity at 100° C. of at least about 7.0 centistokes; and (3) wherein the weight ratio of said first mineral oil to said second mineral oil is from about 80:20 to about 35:65;

(b) a first polymethacrylate viscosity index improver;

(c) a second polymethacrylate viscosity index improver having a higher thickening efficiency and a lower shear stability than said first polymethacrylate viscosity index improver;

(d) a performance additive package comprising from about 1 weight percent to about 10 weight percent based on the weight of said tractor hydraulic fluid composition; and (e) wherein said tractor hydraulic fluid composition has:

(1) an unsheared kinematic viscosity at 100° C. of at least about 9.1 centistokes;

(2) a sheared kinematic viscosity at 100° C. of at least about 7.1 centistokes; and (3) a Brookfield viscosity at −40° C. of no greater than about 20,000 centipoise.

* * * * *